United States Patent [19]

Föhl

[11] 4,313,246

[45] Feb. 2, 1982

[54] BELT BUCKLE OR LOCK FOR A SAFETY BELT

[75] Inventor: Artur Föhl, Schorndorf-Haubersbronn, Fed. Rep. of Germany

[73] Assignee: Repa Feinstanzwerk GmbH, Alfdorf, Fed. Rep. of Germany

[21] Appl. No.: 169,632

[22] Filed: Jul. 16, 1980

[30] Foreign Application Priority Data

Jul. 23, 1979 [DE] Fed. Rep. of Germany ..... 2929803

[51] Int. Cl.[3] ..... A44B 11/26

[52] U.S. Cl. ..... 24/230 AT; 24/230 A; 24/230 AK; 297/468

[58] Field of Search ..... 24/230 AT, 230 A, 230 AK, 24/230 R; 297/468

[56] References Cited

U.S. PATENT DOCUMENTS

| | | | |
|---|---|---|---|
| 2,856,665 | 10/1958 | Gimalouski | 24/230 AK |
| 3,146,846 | 9/1964 | Gutshall | 24/230 AT |
| 3,514,821 | 6/1970 | Saxmark | 24/230 A |
| 3,597,811 | 8/1971 | Cunningham | 24/230 A |
| 3,648,333 | 3/1972 | Stuffel | 24/230 AT |
| 3,713,192 | 1/1973 | Wallin | 24/230 AT |
| 3,789,467 | 2/1974 | Aratani et al. | 24/230 AT |

FOREIGN PATENT DOCUMENTS

| | | | |
|---|---|---|---|
| 2649763 | 5/1978 | Fed. Rep. of Germany | 24/230 AT |
| 2755865 | 6/1978 | Fed. Rep. of Germany | 24/230 AT |
| 1430654 | 3/1976 | United Kingdom | 24/230 AT |
| 2029498 | 7/1979 | United Kingdom | 24/230 AT |

*Primary Examiner*—Victor N. Sakran

*Attorney, Agent, or Firm*—Herbert L. Lerner; Lawrence A. Greenberg

[57] ABSTRACT

Belt-lock and plug-in tongue for a safety belt having a locking mechanism with two locking latches for locking the tongue, tensioned against each other by a spring, and with one locking latch disposed on each side of the plug-in tongue. A hand-actuated member is movable against disengaging means of the locking mechanism to simultaneously move the two locking latches out of engagement with the tongue to permit removal of the tongue from the lock-housing. This assures symmetrical absorption by the belt lock through the latches of forces introduced by the belt system, and also equal distribution of the pulling forces to both locking latches so that the effective forces at each locking latch are halved.

7 Claims, 4 Drawing Figures

BELT BUCKLE OR LOCK FOR A SAFETY BELT

BACKGROUND OF THE INVENTION

1. Field of the Invention

This invention relates to a belt buckle or lock for a safety belt having a plug-in passageway in the lock-housing for insertion of a plug-in tongue which can be locked in the housing by a locking mechanism and released by applying pressure to a hand operated member.

2. Description of the Prior Art

In known safety belts having a belt-lock of the above-described type, a locking latch is provided in the interior of a rigid metallic lock housing, which latch is pressed by a spring into the plug-in guide or passageway into which the plug-in tongue is inserted. Usually, the belt-lock is fastened to the frame of the motor vehicle, while the plug-in tongue is secured to the free end of the safety belt, which for example, may be rolled up- and withdrawn from an automatic roll-up device. When the safety belt is put on, i.e. when the plug-in tongue is inserted into the plug-in guide or passageway of the lock-housing, the locking latch engages behind a locking-edge of the plug-in tongue. With a single locking latch, a onesided asymmetrical pull, connected with a more or less strong tilting of the tongue in the plug-in guide results when a load is put on the belt, i.e. in the case of a crash. For this reason it is necessary in such belt-locks to dimension the plug-in path of the tongue, i.e. the guide or passageway of the plug-in tongue, very narrowly and accurately, and to construct the whole lock-housing very solidly, to prevent the destruction or deformation of the belt lock at the occurrence of very strong tilting forces.

SUMMARY OF THE INVENTION

An object of the present invention is to provide a belt lock of the mentioned type in which an extreme mechanical load capability is assured with a simple, uncomplicated and cost-saving construction.

With the foregoing and other objects in view, there is provided in accordance with the invention a belt-lock and plug-in tongue for a safety belt comprising a lock-housing having a plug-in opening, a plug-in tongue having two locking edges with one locking edge disposed on each side of the tongue, for insertion of the plug-in tongue with its two locking edges into the plug-in opening, a locking mechanism with two locking latches tensioned against each other by a spring and with one locking latch disposed on each side of the plug-in opening to engage the locking edges on each side of the tongue upon insertion of the tongue into the plug-in opening, a hand-actuated member movable against the force of a spring mounted on the lock-housing, the locking mechanism having disengaging means to move the two locking latches out of engagement with the two locking edges, the hand-actuated member upon pressure exerted thereon moveable against the disengaging means to simultaneously move the two locking latches out of engagement with the two locking edges to permit removal of the tongue from the plug-in opening of the lock-housing.

Other features which are considered as characteristic for the invention are set forth in the appended claims.

Although the invention is illustrated and described herein as embodied in a belt buckle or lock for a safety belt, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
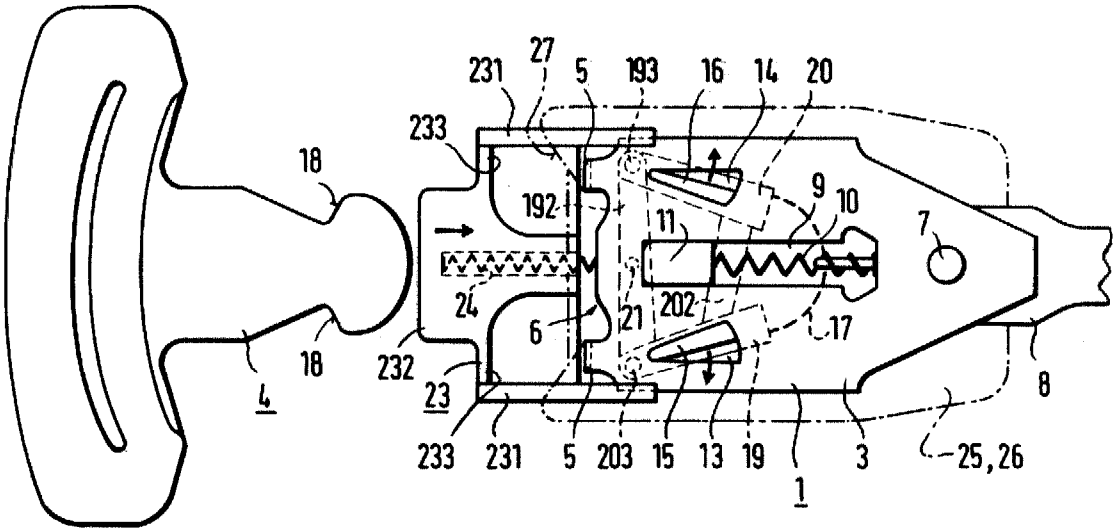
FIG. 1 diagrammatically shows a plan view of a partly assembled lock-housing of the belt buckle in accordance with the invention, together with a plug-in tongue.

The locking mechanism has two locking latches which are tensioned against each other by a spring, i.e. any tendency to pull or spread the two locking latches further apart is opposed by a spring.

The locking latches are arranged at both sides, symmetrically to the plug-in path, for locking the plug-in tongue which has two locking edges. The locking latches can be set to the open position by hand-operated pressure means.

Arranging the two locking latches at both sides of the plug-in path for the plug-in tongue, assures symmetrical absorption by the belt lock through the latches of the forces introduced by the belt system. Thus no special requirements with respect to the dimensioning of the belt lock are necessary, for example, the accurate fitting of the plug-in path.

Furthermore, in this manner the pulling forces acting on the lock-housing are equally distributed to both symmetrically arranged locking latches, so that the effective forces at each locking latch are halved.

According to a preferred embodiment of the invention, the two locking latches are disposed at the ends at one side of two two-armed levers, made of a synthetic material, which are hingeably connected with each other in the manner of scissors. The other ends are in the slide path of the pressure means, and are movable relative to each other when the pressure element is operated. These levers which carry the latches as well as the members required for releasing said latches, can be manufactured very advantageously with respect to cost, as for example, they can be made of plastic by injection—or pressure molding, pre-assembled, and simply pressed into the lock-housing. Preferably, the metallic locking latches are embedded in the lever-material simultaneously with the manufacture of the two-armed levers.

A very flat, space-saving and easy to assemble construction results from a further development of the invention, by making the levers each as consisting of a support plate which carries the latch, and a lever projection or arm with a follower-pin extending into the slide path of the hand-actuated member. The support plates on the one hand, and the lever arms which are set off with respect to the support plates by the material thickness of the lever arm, on the other hand, lie in a common plane and the support plates and the lever arms glide alternatingly on each other. A special easy operating condition for the levers is achieved, by making the pressure element or hand-actuated member in the form of a pressure key (button), by choosing a synthetic material for the levers which has good properties with respect to sliding friction.

Practice has shown that the locking latches are particularly well suited to absorb extremely high forces when these latches are made of metal and have a wedge-shaped cross-section.

According to an advantageous embodiment of the invention, a pressure-key is provided as the pressure means which can slide against a spring force along the side edges of the plates of the lock housing, preferably along the boundary edges of one plate. This pressure key is provided with follower-projections in the region of the ends of the two-armed levers which lie on one plate, respectively in the region of their follower pins. Obviously, it is also within the scope of the instant invention to use, instead of a sled-like pressure key, another known pressure means, for example, a pressure key which is arranged at the side of the lock-housing.

Figure 2:
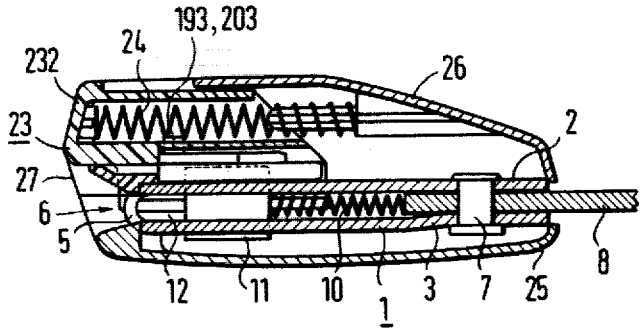
FIG. 2 is a median-sectional view of the lock-housing according to FIG. 1.

Further advantageous details of the invention can be learned from the typical embodiment shown in the drawings and described in the following:

The basic part of the lock-housing according to FIGS. 1 and 2 is a metallic form-part 1 which is bent to a U-shape, and forms two parallel plates 2 and 3. The distance between the two plates 2 and 3 corresponds to the material thickness of a plug-in tongue 4 shown in FIG. 1. The plates 1 and 2 are connected with each other only by the bent portions 5. A plug-in opening 6 for the plug-in tongue 4 is located between these two bent portions. A flat lock-carrier 8 is fastened at the back, open endings of the form-part 1. Carrier 8 can be secured to the frame of the motor vehicle. The plates 2 and 3 are provided with a cut-out 9, approximately in their middle region, in which cut-out 9 a block-shaped ejector 11 is slideably supported and guided against the force of a spring 10. By the insertion of the plug-in tongue 4 into the plug-in passageway 12, which is formed by the two plates 2 and 3, the ejector 11 is pressed toward the rear, thereby compressing spring 10. After releasing the latching mechanism-to be described later-the tongue 4 is ejected from the plug-in guide 12 by the spring 10 under tension. Furthermore, the plates 2 and 3 have two wedge-shaped cut-outs 13 and 14, symmetrically arranged at both sides of the plug-in guide 12, in which wedge-shaped, metallic latches 15 and 16 are retained and guided. These latches 15 and 16 are provided with rounded, respectively concave, narrow edges, and can be swung by a later-described pressure means from the locked position, shown in FIG. 1, in the direction of the arrows to the unlocked position. Said latches 15 and 16 which are tensioned against each other by a bow-shaped spring 17, rest elastically behind the locking-edges 18 of the plug-in tongue 4 when the tongue is pushed into the plug-in guide 12, and thereby lock this tongue. To unlock this plug-in tongue 4, the latches 15 and 16 are moved in the direction of the arrow in a later described manner, until they are outside of the locking-edges 18, which causes the ejection of tongue 4 by the spring 10.

Figure 3:
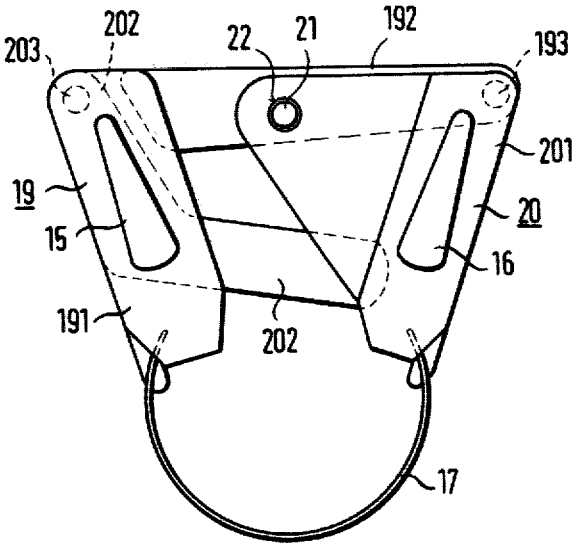
FIGS. 3 and 4 show the locking mechanism used in the belt buckle according to FIGS. 1 and 2, in a plan view and side view.

In the following, the locking mechanism of which the latches 15 and 16 are part, will be explained with the aid of the enlarged details in FIGS. 3 and 4. This locking mechanism is only schematically indicated in FIG. 1 by dotted lines. The locking mechanism includes two two-armed levers 19 and 20, made of a synthetic material. The lever 19 is provided with a bearing pin 21 on which the other lever 20 is hingeably supported in a corresponding bearing hole 22. Lever 19 comprises a support plate 191 containing the latch 15, for example, the latch can be formed into the support plate. In one piece with the support plate 191, there is a lever arm 192 which carries the pivot pin 21 and at its free end the follower pin 193. The two-armed lever 20 also comprises a support plate 201, and additionally an approximately L-shaped lever extension 202, which also carries at its free end a follower-pin 203. The latch 16 is disposed in the support plate 201. The support plate and the lever extension are made in one piece in both levers. The lever extensions 192 and 202 are offset from the associated support plates 191 and 201, by their material thickness. In this manner, the support plates 191, 201 as well as the lever extensions 192, 202 lie respectively in a common plane, as FIG. 4 clearly shows. Thereby the lever extension of one lever always overlaps the support plate of the other lever, (FIG. 3), so that the two levers 19 and 20 can alternatingly slide on each other. As shown in FIG. 3, the free ends of the bow-shaped spring 17 are secured in suitable openings in the support plates 191 and 201, tensioning the levers 19 and 20 against each other by spring action.

Figure 4:
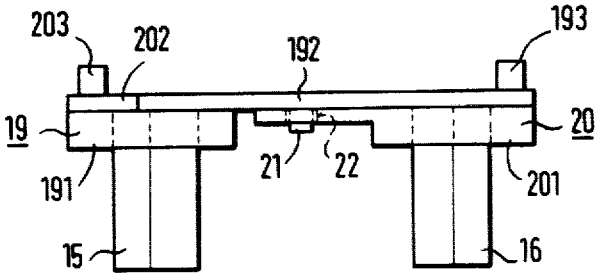

The assembly unit described in FIGS. 3 and 4 is placed on plate 2 of the lock-housing, so that the free-extending latches 15 and 16 engage in the corresponding cut-outs 13 and 14 of the two plates 2 and 3 and are guided therein, as clearly shown in FIG. 1. A pressure means in the form of a pressure key 23 is provided for operating the locking-mechanism shown in FIGS. 3 and 4. This pressure key 23 has at its side, guide lugs 231 with guide grooves which are not shown, by which the pressure key 23 is guided at the parallel border edges of plate 2, so that the pressure key 23 is slideable along the plate 2 of the lock housing. In FIG. 1, for better clarity, the pressure key 23 is shown in a displaced position with respect to the lock-housing 1. The pressure key 23 which is provided with a hand actuator 232, is acted upon by spring 24, and the pressure key 23 can slide with respect to the lock-housing against the force of said spring. In the region (height) of the follower-pins 193 and 203, the pressure-key 23 is provided with follower-projections 233 (FIG. 1) which contact onto the follower-pins 193 and 203 when the pressure-key 23 is operated, i.e. is slid-in. If the pressure key 23 is pushed in further, the two levers 19 and 20 are, like scissors, pivoted with respect to each other around the pivot point at the support pin 21 and the follower pins 193 and 203, whereby the latches 15 and 16 are moved to the unlocked position against the force of spring 17, in the direction of the arrow A as shown in FIG. 1. Hereby, the two levers glide on each other. Now the locking edges 18 of the plug-in tongue 4 are free, and the tongue 4 is ejected from the lock housing by the spring loaded ejector 11. After the pressure key 23 is released, the levers 19 and 20, and thereby the latches 15 and 16, are again reset to the lock position by the spring 17.

In FIGS. 1 and 2 it is indicated by dotted lines that the lock housing with all parts connected therein can be surrounded by two housing shells 25 and 26 which enclose the previously described parts, and form a centered entrance opening 27 for the push-in tongue 4, which is connected to a safety belt that is not shown in more detail.

There are claimed:

1. Belt-lock and plug-in tongue for a safety belt comprising a lock-housing having a plug-in opening, a plug-in tongue having two locking edges with one locking edge disposed on each side of the tongue, for insertion of the plug-in tongue with its two locking edges into the plug-in opening, a locking mechanism with two metal locking latches, each having a wedge-shaped cross section, tensioned against each other by a common spring and with one locking latch disposed on each side of the plug-in opening to engage said locking edges on each side of the tongue upon insertion of the tongue into the plug-in opening, said lock-housing formed by two metal plates which are parallel to each other, and form the plug-in openings, said plates having wedge-or triangular shaped cut-outs arranged symmetrically to the path of the plug-in tongue and in which cut-outs said locking latches are retained without use of bearing pins but are movable therein to engage the locking edges of the tongue, a hand-actuated member movable against the force of a spring mounted on the lock-housing, said locking mechanism having disengaging means to move the two locking latches out of engagement with said two locking edges, said hand-actuated member upon pressure exerted thereon movable against said disengaging means to simultaneously move said two locking latches out of engagement with said two locking edges to permit removal of the tongue from the plug-in opening of the lock-housing.

2. Belt-lock and plug-in tongue according to claim 1, wherein said locking mechanism has the two locking latches disposed at one side at the ends of two two-armed levers, which are hingeably connected with each other, in the manner of scissors, wherein each said locking latch is at one end of each said two-armed lever, and wherein the other two ends of said two two-armed levers are disposed in the path of movement of said hand-actuated member, and are movable when the pressure is exerted on said hand-actuated member.

3. Belt-lock and plug-in tongue according to claim 2, wherein each of said two-armed levers comprises a support plate which carries said locking latch, and a lever arm, and wherein the support plates lie in a common plane, and the lever arms are offset with respect to the support plates by the material thickness of the lever arm, and lie in another common plane, and the support plates and the lever arms glide alternatingly on each other.

4. Belt-lock and plug-in tongue according to claim 3, wherein each said lever arm has a follower-pin extending into the path of movement of said hand-actuated member to thereby simultaneously move said two locking latches out of engagement with said two locking edges.

5. Belt-lock and plug-in tongue according to claim 3, wherein said support plates of the two levers are hingeable with respect to each other on a common pivot bearing, and are tensioned against each other by a ring-shaped spring.

6. Belt-lock and plug-in tongue according to claim 1, wherein said plates are parallel legs formed by shaping a metal blank into a U-shaped part.

7. Belt-lock and plug-in tongue according to claim 1, wherein said hand-actuated member is guided at the boundary edges of one plate, and can slide along the side edges of the plate against said force of a spring, said hand-actuated member having follower projections for contact and movement of said disengaging means of the two-armed levers.

* * * * *